US007121993B2

(12) United States Patent
Matsumoto

(10) Patent No.: US 7,121,993 B2
(45) Date of Patent: Oct. 17, 2006

(54) SHEET FOLDING APPARATUS

(75) Inventor: Masashi Matsumoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 116 days.

(21) Appl. No.: 11/058,317

(22) Filed: Feb. 16, 2005

(65) Prior Publication Data

US 2006/0049574 A1 Mar. 9, 2006

(30) Foreign Application Priority Data

Sep. 3, 2004 (JP) ..... 2004-257162

(51) Int. Cl.
*B31F 1/10* (2006.01)

(52) U.S. Cl. ..... 493/434; 493/424; 493/425; 493/431

(58) Field of Classification Search ..... 493/434, 493/424, 425, 426, 427, 429, 431, 435, 442, 493/444, 23, 26
See application file for complete search history.

(56) References Cited

U.S. PATENT DOCUMENTS 4,053,150 A * 10/1977 Lane ..... 493/417
4,452,597 A * 6/1984 Achelpohl ..... 493/204
4,643,705 A * 2/1987 Bober ..... 493/444
5,842,964 A * 12/1998 Huber et al. ..... 493/434
6,022,011 A * 2/2000 Hirose ..... 270/37
6,568,668 B1 * 5/2003 Wakabayashi et al. ... 270/58.11
6,602,177 B1 * 8/2003 Muir ..... 493/424
6,939,283 B1 * 9/2005 Sparano et al. ..... 493/424

FOREIGN PATENT DOCUMENTS

JP 2001-146363 5/2001

* cited by examiner

*Primary Examiner*—Sameh H. Tawfik
(74) *Attorney, Agent, or Firm*—Morgan, Lewis & Bockius LLP

(57) ABSTRACT

A sheet folding apparatus for folding a set of sheets into two at a center thereof, includes: a sheet number recognition section that recognizes the number of sheets in the set; a pair of rotating rollers pressed against each other to form a nip portion; a blade member retractably moves with respect to the nip portion; and a blade member control section that controls the blade member to move toward the nip portion to push the set of sheets in the nip portion at a depth corresponding to the number of sheets recognized by the sheet number recognition unit.

2 Claims, 6 Drawing Sheets

SHEET FOLDING APPARATUS

BACKGROUND OF THE INVENTION

1. Field of the Invention

The present invention relates to a sheet folding apparatus for folding a set of sheets into two at the center.

2. Description of the Related Art

Conventionally, some of image forming apparatuses such as a copying machine or printer have a function called a booklet process. In the booklet process, the center of the sheets in which the image is formed is stapled and the set of sheets is folded into two at the center.

In the image forming apparatus having this kind of function, while the set of sheets stapled at the center is delivered to the nip portion where the pair of rotating rollers is pressed against each other, the set of sheets is folded into two at the center by passing the set of sheets through the nip portion (for example, see Japanese Patent Laid-Open Publication No. 11-332734).

However, in the image forming apparatus proposed by the above reference, forming an image on the sheet sometimes decreases frictional force between a sheet in direct contact with the rotating roller and a sheet beneath the sheet in direct contact with the rotating roller. In this case, it is reported that only the sheet in direct contact with the rotating roller is stripped from the set of sheets and thereby taken into the nip portion ahead of other sheets.

As a countermeasure, it is proposed to use a blade member to deliver the set of sheets to the nip portion by pushing them in. In this proposal, a sheet in direct contact with the rotating roller and a sheet beneath the sheet in direct contact with the rotating roller are caused to come into contact with each other by pressure of the blade member, which prevents the sheet in direct contact with the rotating roller from being stripped from the set of sheets and taken into the nip portion ahead of other sheets.

However, only by pushing the set of sheets in with the blade member, a trace of the blade member may remain on the sheet depending on the number of sheets included in the set of sheets.

The above problem is generated not only in the case where the blade is pressed against paper, but also in the case where the blade is pressed against sheet-like medium other than paper. Further, the problem is also generated in the set of sheets which is not stapled.

SUMMARY OF THE INVENTION

The present invention has been made in view of the above circumstances and provides a sheet folding apparatus which passes the set of sheets through the nip portion without stripping off, and reduces a load on the set of sheets, which is caused by the push-in of the set of sheets with the blade member.

According to an aspect of the present invention, a sheet folding apparatus for folding a set of sheets into two at a center thereof, includes: a sheet number recognition section that recognizes the number of sheets in the set; a pair of rotating rollers pressed against each other to form a nip portion; a blade member retractably moves with respect to the nip portion; and a blade member control section that controls the blade member to move toward the nip portion to push the set of sheets in the nip portion at a depth corresponding to the number of sheets recognized by the sheet number recognition unit.

BRIEF DESCRIPTION OF THE DRAWINGS

An embodiment of the present invention will be described in detail based on the following figures, wherein.

DETAILED DESCRIPTION OF THE INVENTION

Referring now to the accompanying drawings, an embodiment of the invention will be described in detail.

Figure 1:
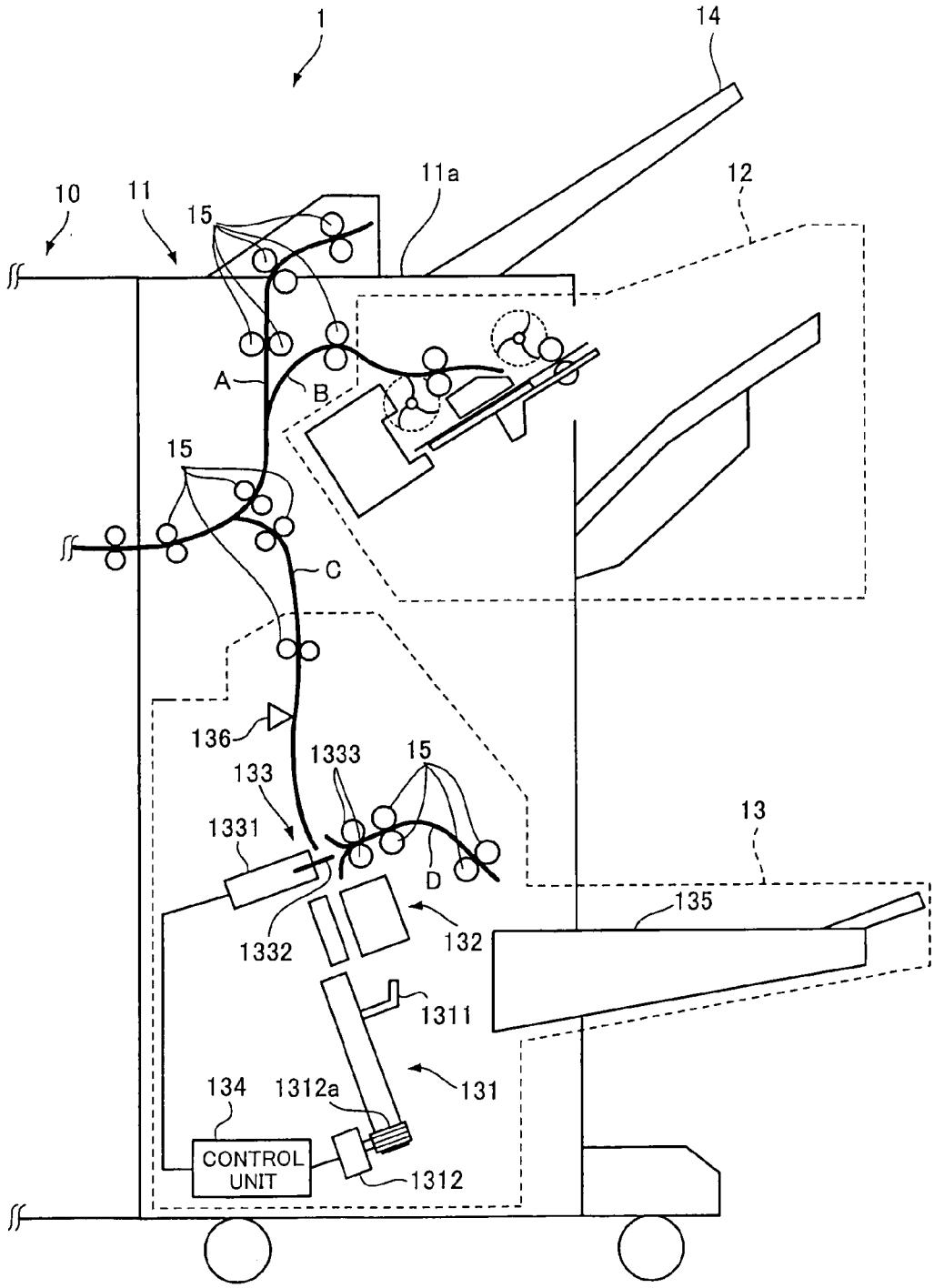
FIG. 1 schematically shows part of a copying machine provided with a sheet folding apparatus according to an embodiment of the invention.

FIG. 1 schematically shows part of a copying machine provided with a sheet folding apparatus according to the embodiment of the invention.

A copying machine 1 has an image forming apparatus 10 and a post-processing apparatus 11. A recording sheet in which the image is already formed is conveyed from the image forming apparatus 10 to the post-processing apparatus 11, and the post-processing apparatus 11 performs a stapling process and a folding process to the recording sheet.

The post-processing apparatus 11 has a stapling-processing unit 12 and a booklet processing unit 13. The stapling-processing unit 12 staples end portions of the stacked plural sheets. The booklet processing unit 13 performs the stapling process of stapling central portions of the stacked plural sheets, and also performs the folding process of folding the set of sheets whose central portions are folded into two at the central portions of the sheets. The sheet folding apparatus according to the embodiment of the invention is installed in the booklet processing unit 13.

The post-processing apparatus 11 has a first sheet conveying path A, a second sheet conveying path B, and a third sheet conveying path C. The first sheet conveying path A directly discharges the recording sheet conveyed from the image forming apparatus to a top surface of the post-processing apparatus 11, the second sheet conveying path B conveys the recording sheet to the stapling-processing unit 12, and the third sheet conveying path C conveys the recording sheet to the booklet processing portion 13. Conveying rollers 15 are provided in each sheet conveying path. The recording sheet conveyed by the first sheet conveying path A is discharged toward a first sheet-discharge tray 14 provided on the top surface of a frame 11*a* of the post-processing apparatus 11. Because the stapling-processing unit 12 has no relation to the invention, the description of the stapling-processing unit 12 is omitted, and only the booklet processing portion 13 will be described below.

The booklet processing portion 13 has a compiler tray 131, a stapler 132, a sheet folding device 133, control unit 134, a second paper-discharge tray 135, a photosensor 136, and a fourth sheet conveying path D. The recording sheets are temporarily stored in the compiler tray 131 to arrange the sheets to be conveyed through the third sheet conveying path C. The stapler 132 staples the central portions of the sheets which are arranged and stacked on one another in the compiler tray 131. The sheet folding device 133 folds the set of sheets stapled by the stapler 132 into two at the central portions of the sheets. The control unit 134 controls the whole booklet processing portion 13. The set of sheets to which the booklet processing has been performed is discharged to the second paper-discharge tray 135. The photosensor 136 is used in order to count the number of sheets included in the set of sheets. The fourth sheet conveying path D conveys the set of sheets folded into two to the second paper-discharge tray 135. The sheet folding apparatus according to the embodiment of the invention has the sheet folding device 133, the control unit 134, and the photosensor 136.

The sheet folding device 133 shown in FIG. 1 has a drive unit 1331, a blade member 1332, and a pair of rotating rollers 1333 which is pressed against each other. The blade member 1332 pushes the set of sheets in a nip portion formed between the pair of rotating rollers 1333. The drive unit 1331 is retractable with respect to the nip portion and pushes the set of sheets in the nip portion to a predetermined depth by protruding the blade member 1332 according to an instruction from the control unit 134.

The compiler tray 131 has a positioning member 1311 and a stepping motor 1312. The positioning member 1311 is attached to a rack (not shown) which engages a pinion gear 1312*a*, and the pinion gear 1312*a* is attached to a rotating axis of the stepping motor 1312. When the stepping motor 1312 receives the instruction from the control unit 134, the stepping motor 1312 moves the positioning member 1311 attached to the rack. The positioning member 1311 is moved in an approximately vertical direction to change a position of the sheet while supporting a bottom portion of the sheet stored in the compiler tray.

A flow of the process in the booklet processing portion 13 will be described.

Figure 2:
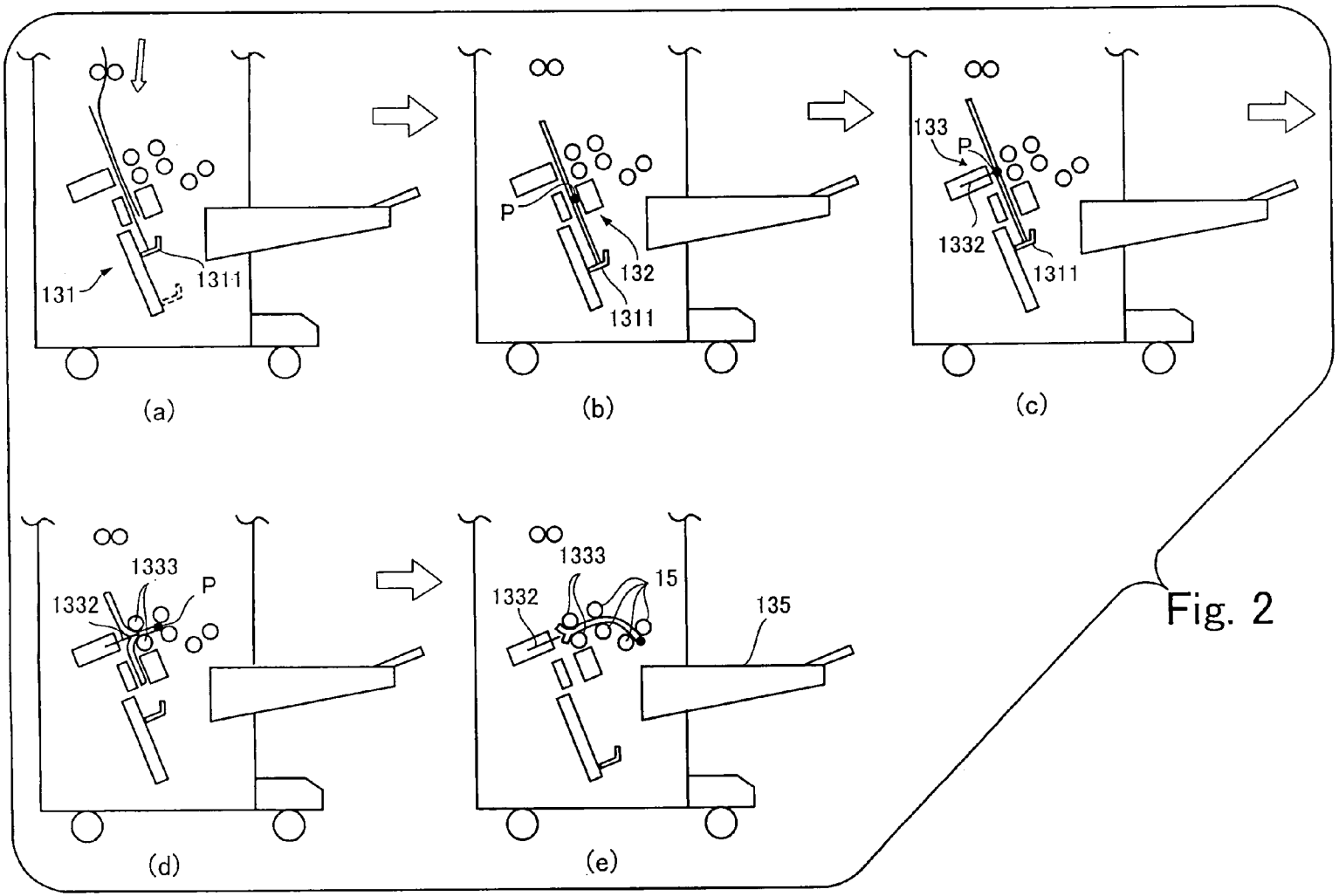
FIG. 2 is a schematic view showing a sequence of actions of a booklet processing portion shown in FIG. 1.

FIG. 2 is a schematic view showing a sequence of actions of the booklet processing portion shown in FIG. 1.

Part (a) of FIG. 2 shows the state in which the plural sheets sequentially conveyed to the compiler tray 131 are supported and arranged by the positioning member 1311. In part (a) of FIG. 2, the positioning member 1311 is moved upward from a home position shown by a dotted line.

Part (b) of FIG. 2 shows the state in which, when all the sheets are stored in the compiler tray 131, the positioning member 1311 is moved downward from the position shown in part (a) of FIG. 2 so that a center P of the sheets corresponds to a stapling position of the stapler 132. Then, the stapler 132 staples the center P of the sheets to form the set of the sheets.

In part (c) of FIG. 2, the positioning member 1311 supporting the set of sheets is moved upward from the position shown in part (b) of FIG. 2 so that the center P of the set of sheets is arranged in front of the blade member 1332 of the sheet folding device 133.

In part (d) of FIG. 2, when the blade member 1332 proceeds to the nip portion of the pair of rotating rollers 1333, the center P of the set of sheets is pushed in the nip portion of the pair of rotating rollers 1333, thereby being folded into two.

In part (e) of FIG. 2, the blade member 1332 is extracted from the nip portion of the pair of rotating rollers 1333, and the set of sheets folded into two is being discharged to the second paper-discharge tray 135 by the conveying rollers 15.

Figure 3:
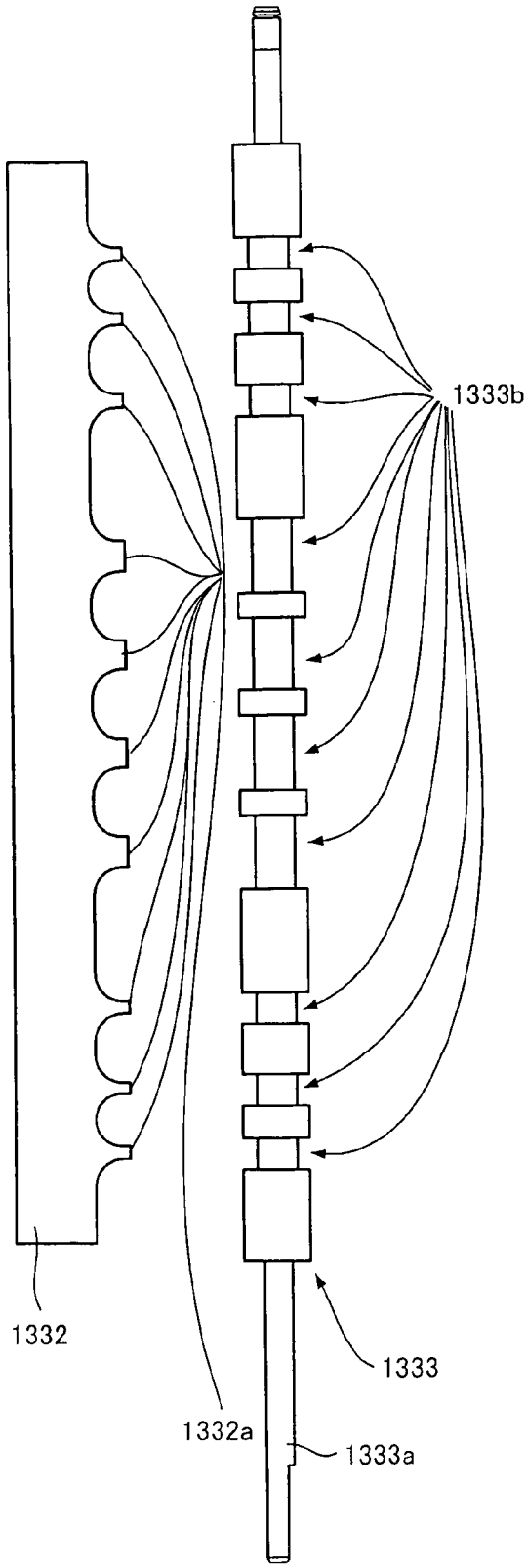
FIG. 3 shows a blade member and a pair of rotating rollers when viewed from a top surface side.

FIG. 3 shows the blade member and the pair of rotating rollers when viewed from a top surface side.

Grooves 1333*b* are intermittently provided in the pair of rotating rollers 1333 shown in FIG. 3. The grooves 1333*b* are formed in a circumference of the roller 1333. In the blade member 1332 shown in FIG. 3, leading edges 1332*a* are intermittently formed corresponding to the grooves 1333*b* provided in the pair of rotating rollers 1333. Because of the shape of the blade member 1332 described above, the leading edges 1332*a* of the blade member 1332 enter the grooves 1333*b* of the pair of rotating rollers 1333 through the set of sheets when the blade member 1332 proceeds toward the pair of rotating rollers 1333. The detail of the shape of the blade member 1332 and the rotating roller 1333 will be described later. A central shaft 1333*a* of the rotating roller 1333 is also shown in FIG. 3.

Figure 4:
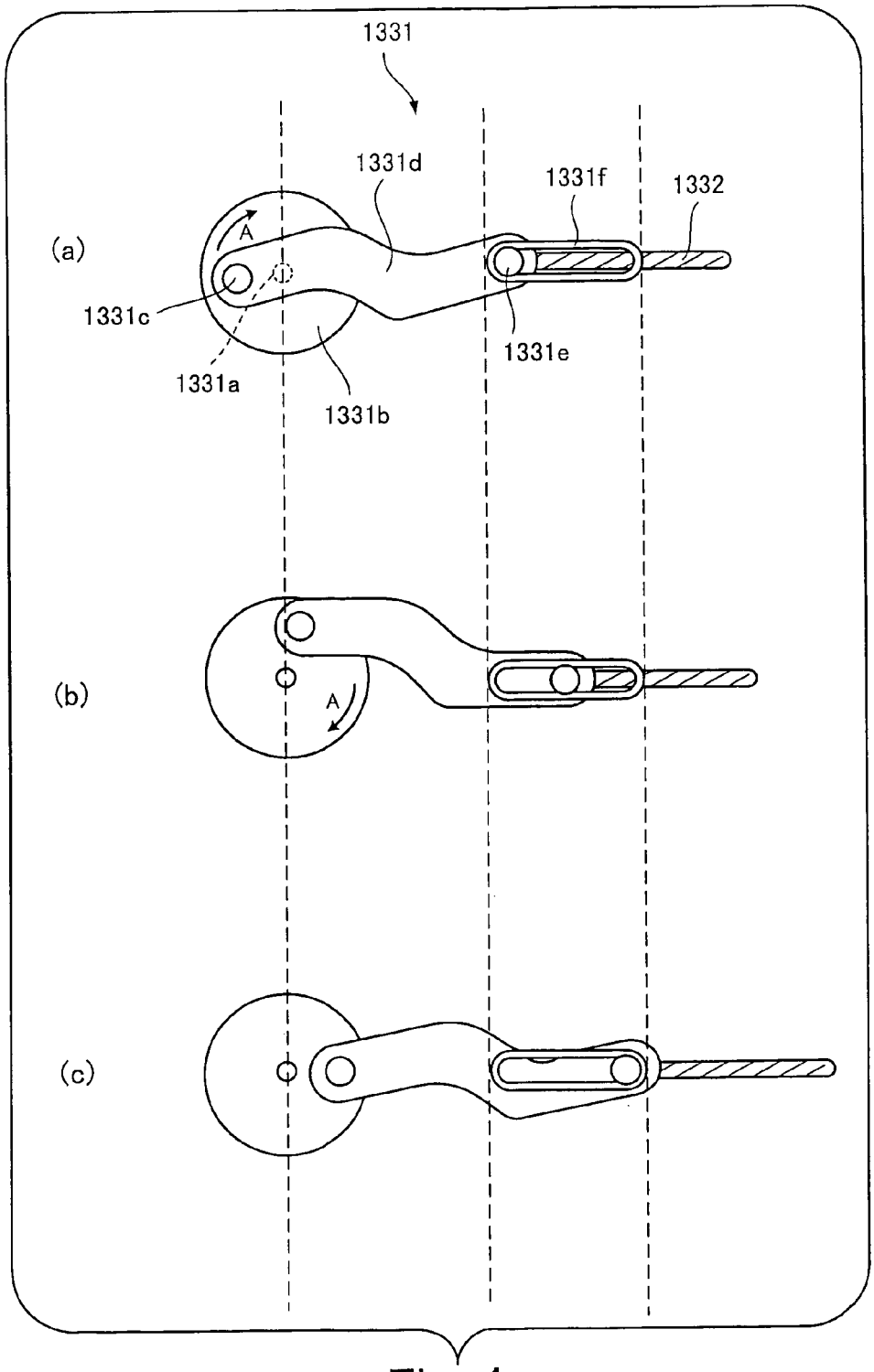
FIG. 4 shows an inside of a drive unit which retractably moves the blade member with respect to a nip portion of the rotating rollers.

FIG. 4 shows the inside of the drive unit which retractably moves the blade member with respect to the nip portion of the rotating rollers.

The drive unit 1331 shown in FIG. 4 has a wheel 1331*b*, an arm 1331*d*, and a guide frame 1331*f*. The wheel 1331*b* is fixed to the rotating shaft 1331*a* of the stepping motor. One end portion of the arm 1331*d* is attached to the wheel 1331*b* by a first shaft 1331*c*. The guide frame 1331*f* has a long hole into which a second shaft 1331*e* is fitted, and the second shaft 1331*e* is fixed to the other end portion of the arm 1331*d*. The blade member 1332 is attached to the end portion of the arm 1331*d* on the side where the second shaft 1331*e* is fixed. Further, the stepping motor and the guide frame 1331*f* are fixed to predetermined positions in the apparatus respectively. Therefore, in the drive unit 1331, rotational motion of the stepping motor is converted into linear motion of the blade member 1332.

Part (a) of FIG. 4 shows the state in which the blade member 1332 is retracted to the most backward position. In the sheet folding device 133, the position shown in part (a) of FIG. 4 is the home position of the blade member 1332.

Part (b) of FIG. 4 shows the state in which the wheel 1331*b* is rotated by 90° in an arrow A direction from the position shown in part (a) of FIG. 4. Part (c) of FIG. 4 shows the state in which the wheel 1331*b* is further rotated by 90° in the arrow A direction from the position shown in part (b) of FIG. 4. Part (c) of FIG. 4 shows the state in which the blade member 1332 is protruded to the most forward position.

In the sheet folding device 133, a push-in depth is changed according to the number of sheets included in the set of sheets. The push-in depth is the depth to which the set of sheets is pushed in the nip portion of the pair of rotating rollers. The push-in depth is changed by controlling the rotation angle of the stepping motor of the drive unit 1331.

Therefore, in the sheet folding device 133, when the control unit 134 provides the instruction that the stepping motor is rotated to the predetermined rotation angle so that the set of sheets is pushed in the nip portion to the push-in depth according to the number of sheets included in the set of sheets. After the stepping motor is rotated to the predetermined rotation angle, the stepping motor is rotated in the opposite direction to the arrow A to return the blade member 1332 to the home position shown in part (a) of FIG. 4. Alternatively, the blade member 1332 may be returned to the home position by rotating the stepping motor further in the arrow A direction, after the set of sheets is pushed in the nip portion to the push-in depth according to the number of sheets included in the set of sheets and the set of sheets is drawn in the nip portion.

Figure 5:
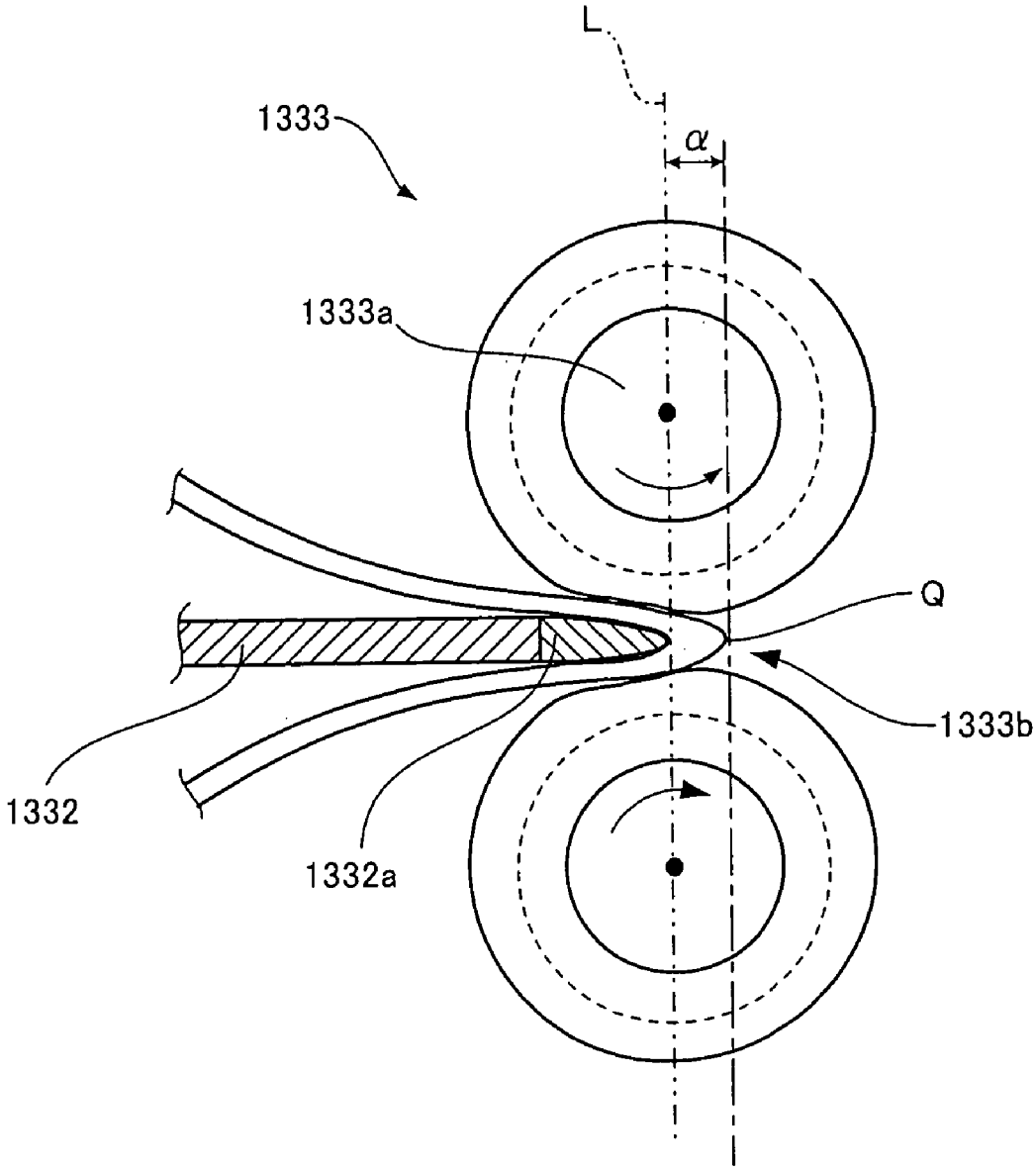
FIG. 5 shows a state in which the blade member pushes a set of sheets in the nip portion.

FIG. 5 shows the state in which the blade member pushes the set of sheets in the nip portion.

FIG. 5 shows the state in which the leading edge 1332*a* of the blade member 1332 pushes the set of sheets in the nip portion. In the sheet folding device 133, the number of sheets included in the set of sheets is recognized by the control unit 134 which receives a signal from the photosensor 136, and the control unit 134 controls a distance α between a chain double-dashed line L which links centers of the rotating rollers 1333 and a folded position Q of the set of sheets according to the number of sheets recognized by the control unit 134. The distance α is a push-in amount of the set of sheets by the blade member 1332. Further, in the sheet folding device 133, the rotation angle of the stepping motor is determined according to a combination of the number of sheets included in the set of sheets and the distance α. As shown in FIG. 3, the leading edge 1332*a* of the blade member 1332 is configured so as to enter the groove 1333*b* of the pair of rotating rollers 1333 through the set of sheets. This aims to prevent pullback of the set of sheets by causing the leading edge 1332*a* of the blade member 1332 to intrude in a non-nip portion (where a pair of rotating rollers are not in contact with each other, 1333*b*) to push the set of sheets in while reducing the frictional force between the blade member and the set of sheets when the blade member 1332 is extracted from the nip portion while the set of sheets is nipped. Therefore, the set of sheets can be pushed in without applying excessive force which causes wrinkle to the set of sheets.

Figure 6:
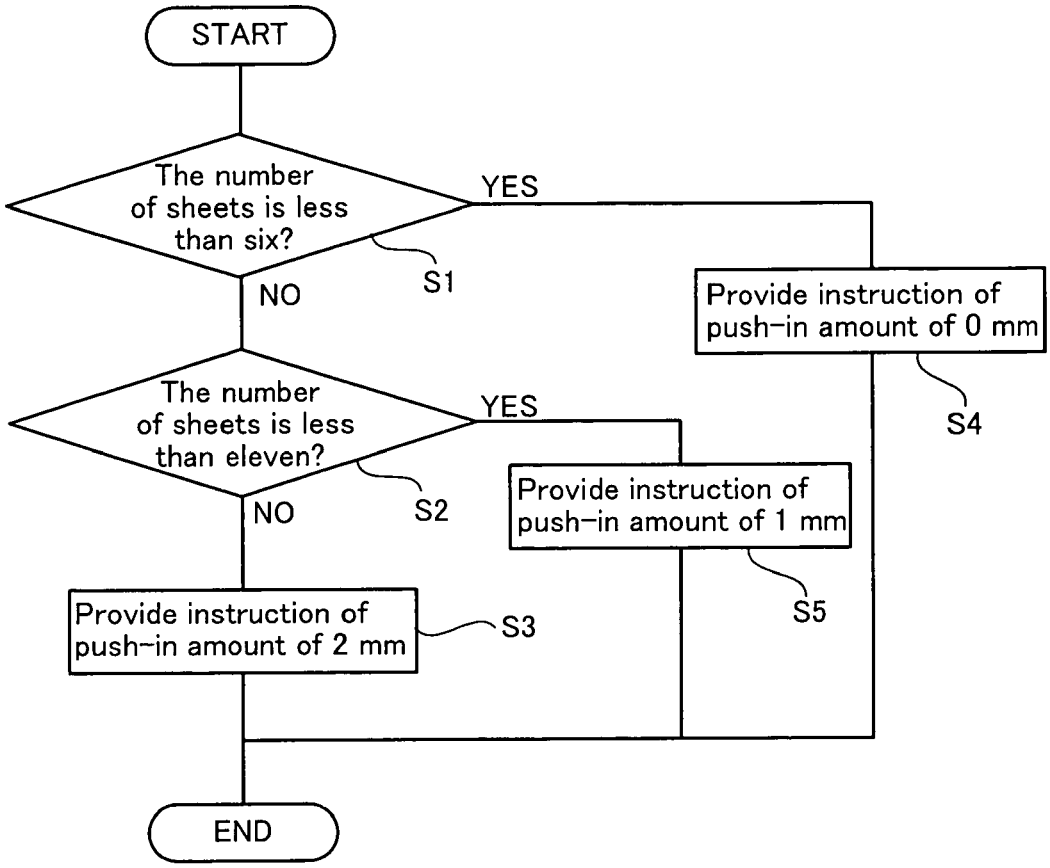
FIG. 6 is a flowchart of a routine which determines a distance $\alpha$ according to the number of sheets included in the set of sheets.

FIG. 6 is a flowchart of a routine which determines the distance α according to the number of sheets included in the set of sheets.

FIG. 6 shows the routine to be started up when the sheets, of which the number of sheets is previously specified, are stored in the compiler tray 133. In Step S1, it is decided whether the number of the sheets is less than six or not. When the number of the sheets is not less than six, the routine proceeds to Step S2. In Step S2, it is decided whether the number of the sheets is less than eleven or not. When the number of the sheets is not less than eleven, the routine proceeds to Step S3, and the control unit 134 provides the instruction of the push-in amount, i.e. the distance α of 2 mm to the drive unit 1331. Then, the routine is ended. Therefore, the folded position Q of the set of sheets pushed in with the blade member 1332 is further pushed in the position 2 mm deeper than the chain double-dashed line L, which links the centers of the rotating rollers 1333.

On the other hand, in Step S1, when the number of the sheets is less than six, the routine proceeds to Step S4, and the control unit 134 provides the instruction of the distance α of 0 mm to the drive unit 1331. Then, the routine is ended. Therefore, the folded position Q of the set of sheets pushed in with the blade member 1332 is further pushed in to reach the chain double-dashed line L which links the centers of the rotating rollers 1333. In Step S2, when the number of the sheets is less than eleven, the routine proceeds to Step S5, and the control unit 134 provides the instruction of the distance α of 1 mm to the drive unit 1331. Then, the routine is ended.

As described above, when the number of sheets included in the set of sheets is small, the set of sheets can pass completely through the nip portion, even if the push-in amount of the set of sheets in the nip portion by the blade member is decreased when compared with the case in which the number of sheets included in the set of sheets is large. Therefore, in the sheet folding device 13, since the set of sheets is pushed in the nip portion with the push-in amount (distance α) into the nip portion according to the number of sheets included in the set of sheets, the load on the set of sheets including the small number of sheets can be reduced. This is not the case in which the set of sheets is pushed in the nip portion uniformly regardless of the number of sheets included in the set of sheets. As a result, according to the invention, no trace remains in the sheet, which makes the set of sheets look better.

In the embodiment, the grooves 1333*b* formed in the circumference of the roller 1333 are intermittently provided in the pair of rotating rollers 1333, and the leading edges 1332*a* are intermittently formed in the blade member 1332 corresponding to the grooves 1333*b* provided in the pair of rotating rollers 1333. However, in the invention, the rotating roller may be formed in a common cylindrical shape and the blade member may be formed in the blade shape in which the leading edges 1332*a* shown in FIG. 3 are omitted. In the embodiment, the set of sheets in which the stapling process is performed to the center is described by way of example. However, it is also possible to process the set of sheets to which the stapling process is not performed.

The entire disclosure of Japanese Patent Laid-Open Publication No. 2004-257162 filed on Sep. 3, 2004, including specification, claims, drawings and abstract is incorporated herein by reference in its entirety.

What is claimed is:

1. A sheet folding apparatus for folding a set of sheets into two at a center thereof, comprising:

a sheet number recognition section that recognizes the number of sheets in the set;

a pair of rotating rollers pressed against each other to form a nip portion;

a blade member retractably moves with respect to the nip portion; and a blade member control section that controls the blade member to move toward the nip portion to push the set of sheets in the nip portion at a depth corresponding to the number of sheets recognized by the sheet number recognition unit.

2. The sheet folding apparatus according to claim 1, wherein each of the pair of rotating rollers has a portion not in contact with each other, the portion being a groove formed on a circumference and located at the same position in the pair of rotating rollers, and the blade member has a protrusion portion protruding toward the nip portion, the shape of the protrusion portion corresponding to that of the non-contact portion of the pair of rotating rollers.

* * * * *